United States Patent [19]

Koskinen

[11] Patent Number: 5,040,899

[45] Date of Patent: Aug. 20, 1991

[54] MIXER

[75] Inventor: Olavi Koskinen, Halikko, Finland

[73] Assignee: A. Ahlstrom Corporation, Noormarkku, Finland

[21] Appl. No.: 521,318

[22] Filed: May 9, 1990

[30] Foreign Application Priority Data

May 9, 1989 [FI] Finland ..... 892213

[51] Int. Cl.[5] ..... B01F 7/00

[52] U.S. Cl. ..... 366/281; 366/331; 366/251

[58] Field of Search ..... 366/242, 261, 199, 306, 366/307, 285, 286, 279, 244, 302, 331, 347, 251, 249

[56] References Cited

U.S. PATENT DOCUMENTS 2,945,711 7/1960 Dykman ..... 366/331

4,383,768 5/1983 Kupka ..... 366/279

FOREIGN PATENT DOCUMENTS 1044775 10/1981 Japan ..... 366/249

*Primary Examiner*—Harvey C. Hornsby
*Assistant Examiner*—T. Soohoo
*Attorney, Agent, or Firm*—Cohen, Pontani & Lieberman

[57] ABSTRACT

A mixer for attachment to a tank which can be removed therefrom without the necessity of emptying the tank. The mixer includes a mixer frame (18) with bearings and sealings disposed inside a shield (56) surrounding the mixer frame. Frame and shield extend into the mixing tank and are attached to the wall of the tank so that the mixer is detachable from the tank in such a way that, of the moving parts of the mixer, only the mixing member (64, 66) remains inside the tank (80).

7 Claims, 2 Drawing Sheets

MIXER

FIELD OF THE INVENTION

The present invention relates to an apparatus for mixing fluids, and particularly to a mixer shaft having a mixing member at the end thereof and which extends from the side of a mixing tank deep into the space defined thereby.

BACKGROUND OF THE INVENTION

This type of apparatus, called a mixer, is generally used in the wood-processing industry and other chemical industries for mixing various fluids with each other and for mixing solid materials with fluids. These devices are constructed with the object of achieving the greatest possible mixing efficiency with the lowest possible power consumption. Another object is to construct the equipment so that the greatest possible reliability of operation is achieved and that the maintenance or replacement of the shaft sealing and bearing parts may be effected without the necessity of emptying the mixing tank.

In general, the known mixers are inserted into the mixing tank from the side thereof and the reach of the mixing member, such as a mixing blade or propeller, inside the tank is fairly short. The shaft is supported by sealings and bearings at a point which is relatively far from the point of loading caused by the mixing member. In other words, in heretofore known mixers, the shaft has been supported either entirely outside the tank or at least closely adjacent to the wall thereof mainly to facilitate repairs as needed. This, however, necessitates the use of a large diameter mixer shaft to minimize deflections caused by various strains. Consequently, large shaft sealings are needed and, despite the thickness of the shaft, deflections of the shaft which are harmful to the sealing still occur.

An example of the mixer essentially as described above is found in German Patent DE 31 50 537 which discloses an arrangement in which the mixer is mounted on a flange at the wall of the mixing tank so that the entire mixing unit can be removed from the tank. One of the major disadvantages of the apparatus in accordance with that publication, however, is that the mixer cannot be entirely removed unless the mixing tank is emptied at least down to the lower edge of the opening through which it is inserted. A further drawback is the large diameter of the shaft for preventing deflections of the shaft and other stresses to which the bearing system and sealings are subjected.

U.S. Pat. No. 3,539,155 discloses a mixing tank which is entirely closed and in which the mixer is driven by powerful magnets through the cover of the tank. A tapered shell is provided around the mixer shaft and the bearings are arranged both next to the mixing members and close to magnet switch. Although proper support for the mixing shaft has thus been provided, the service of the apparatus has not been given any consideration. Since the mixer is installed in the cover of the mixing tank, the entire mixer can be removed from the tank without emptying the tank contents prior thereto. This arrangement, however, is not possible if the mixer is installed in a sidewall of the tank. In this case, a great number of different factors have to be taken into account, starting from the shaft being deflected by gravity and including numerous sealing problems which occur both during the operation and the service of the apparatus. None of these problems have been considered or addressed in the known prior art publications. In many cases, however, there is also no choice of location of the mixer relative to the mixing tank but the mixer must be disposed at the side of the tank irrespective of the problems caused thereby.

In some installations where the mixer is located at the side of the mixing tank, service of the mixer has been performed successfully by providing the mixer shaft with an additional sealing which can be closed off during service. In that case, it is possible to replace the shaft sealing if the sealing is of a replaceable type. Bearings and sealings that cannot be disassembled may be replaced in some types of shafts by dismantling all drive equipment and support structures of the bearings and by temporarily supporting the shaft.

SUMMARY OF THE INVENTION

It is thus an object of the present invention to provide a mixer with an improved ratio of mixing efficiency and power requirement and wherein the shaft may be sealed substantially more economically by small and non-leaking sealing structures. Furthermore, during normal operation, the mixing apparatus including its shaft may be quickly removed for maintenance or replacement without the necessity of emptying the tank, which is extremely important, particularly with big tanks. Because all moving parts of the mixer, except for the mixing member itself, are readily detachable, it is extremely rare that the tank has to be emptied for the maintenance of the mixer. The only exception is an emergency situation when the vane or blade of the mixing member is broken or the vane or blade has separated from the hub, in which case the tank must be emptied to retrieve the damaged vane or blade from the fluid.

According to the present invention, the shaft of the mixer is mounted on bearings at a point near the mixing member which may, for example, be a blade or propeller. In other words, the bearings and the sealing system of the mixer shaft is arranged on the frame carrying the mixer shaft in the close vicinity of the mixing member. The frame is further surrounded by a shield which prevents the fluid stored inside the tank from contacting the frame. The frame including the shield are preferably tapered toward the mixing member so that the tapered shape contributes to the flow of the fluid. For purposes of service and maintenance the mixer shaft with its drive means can be removed from the tank without the necessity of emptying the tan prior thereto.

BRIEF DESCRIPTION OF THE DRAWINGS

The mixer according to the present invention is further described below, by the way of example, with reference to the accompanying drawings, in which.

DETAILED DESCRIPTION OF THE PRESENTLY PREFERRED EMBODIMENT

Figure 1:
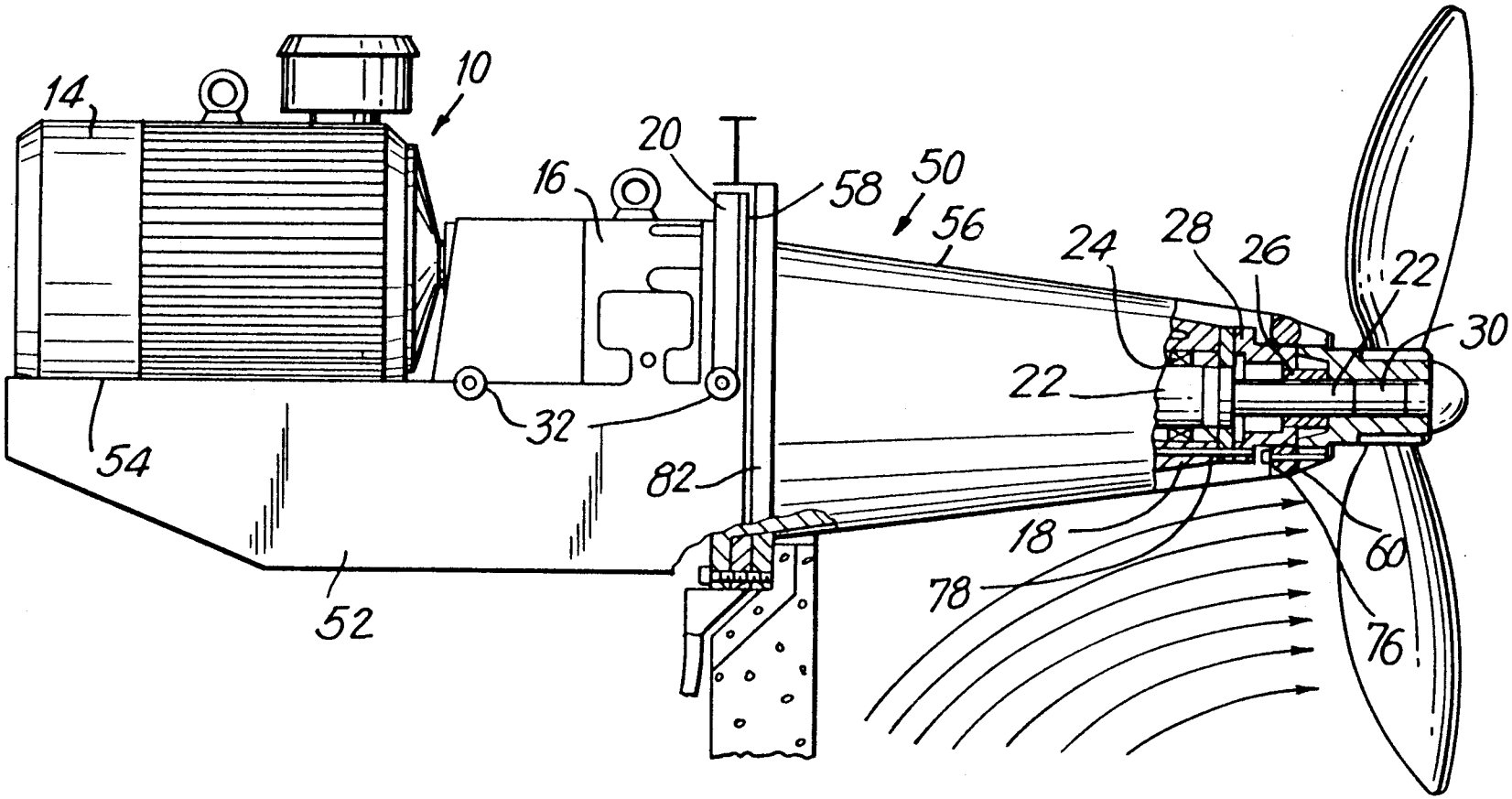
FIG. 1 is an illustration of the mixer according to the present invention in the operating position.
Figure 2:
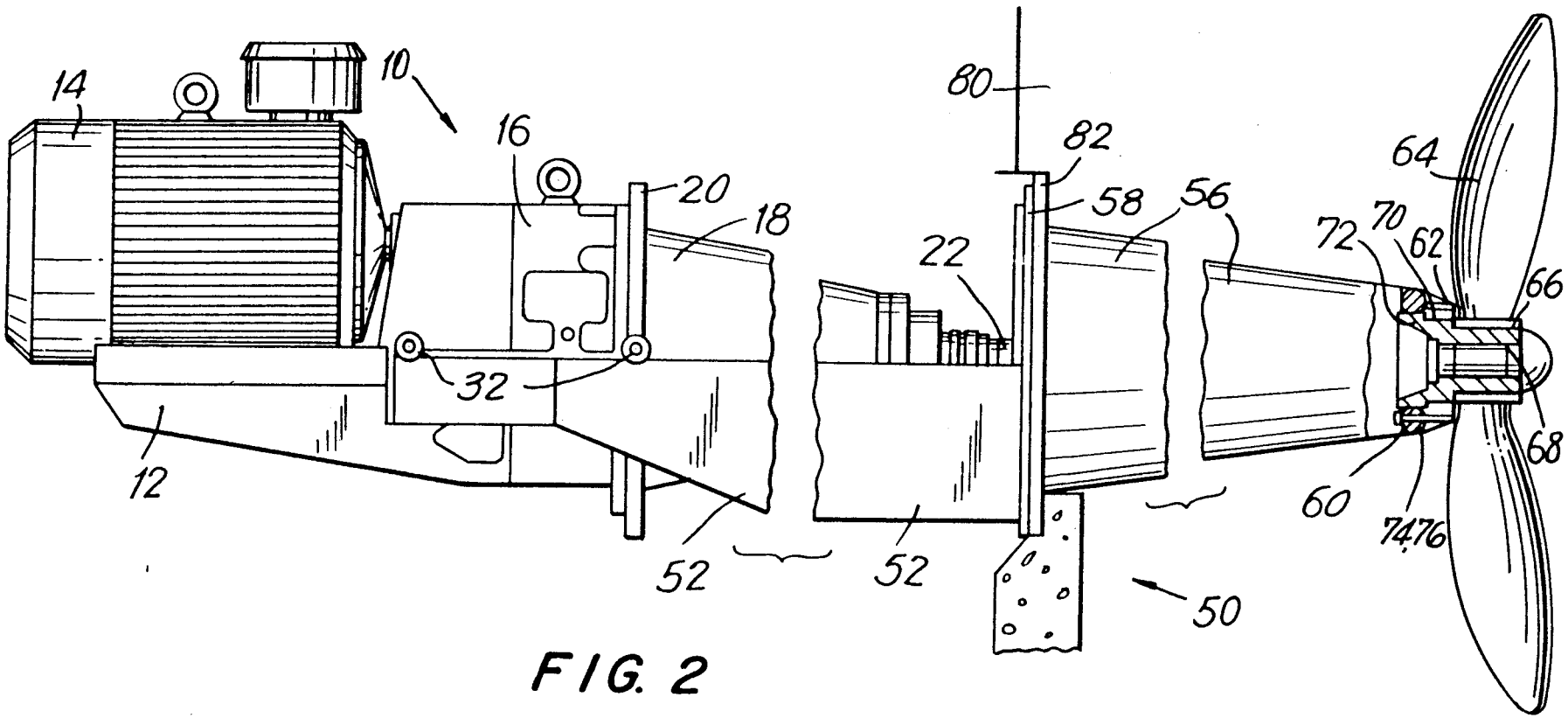
FIG. 2 is an illustration of the mixer of FIG. 1 in the position for service.

As shown in FIGS. 1 and 2, the mixer of the present invention comprises two main parts, 10 and 50. Part 10 is removable. In other words, part 10 may be removed from tank 80 for maintenance and service without the need of emptying tank 80 and without the need to further dismantle the mixer. Part 10 includes bracket 12, the drive motor 14 which is mounted on bracket 12, gear 16 which usually is a gear reducer, and frame 18 extending from the gear toward the interior of the tank 80. The frame 18 is provided with flanges 20 for fastening thereof to the wall of the tank 80. Furthermore, a drive shaft 22 for the mixer is mounted on bearings and the frame 18 in such a manner that an outer support bearing 24, i.e., the bearing 24 at the outer end of the shaft when viewed from gear 16, is disposed as closely to the end of shaft 22 as possible and thus also closely adjacent to the mixing member. The frame 18 is also provided with a shaft sealing 26 and a sealing cage 28. The shaft sealing 26 is arranged so as to prevent the fluid contained in the mixing tank from leaking along the shaft 22 and the frame 18. In case this sealing should fail, the fluid can escape and leak only as far as the end part of frame 18. To this end, sealing cage 28 is also provided with openings through which the fluid will flow into the inner surface of shield 56 and there along further out of the tank 80 and the mixer without the risk of the bearings 24 of the mixer shaft 22 being damaged thereby. This arrangement also ensures that the fluid to be mixed will not be contaminated by lubricants such as grease and/or oils leaking from the bearings. The aforementioned lubricants will flow out of the mixer along the path described above. Thus, the equipment can be easily inspected at the point where the mixer and mixing tank are connected to ensure that the equipment is in proper working order and, in case of a leak, it is easily determined whether a sealing or a bearing has been damaged. At the end of the shaft 22, there is preferably machined a spiral shaped wedge part 30, in accordance with Finnish Patent Publication 864730, corresponding to U.S. Pat. No. 4,863,353, to which wedge part the mixing member having a corresponding wedge part is attached. This type of wedge attachment enables the removal of part 10 from the tank so that the mixing member will remain inside the tank 80. The spiral-wedge attachment is of reliable construction and capable of transferring large torques. It does not become tightly locked by the effect of the torque as do other known wedge attachments. If an ordinary threaded connection were used, it would also tend to jam so tightly that it would be impossible to open the connection merely by turning the shaft. The frame 18 and bracket 12 are equipped with rollers 32 for guiding the part 10 outward from the tank 80 for service.

The second part 50 comprises parts which are fixedly attached to the wall of the tank 80 or parts remaining inside the tank even if the apparatus is in the service position. The only such part that is located outside the tank 80 is the support member 52 which substantially comprises two rails 54 arranged to function together with rollers 32 of the part 10 for allowing part 10 to be removed outward from the tank 80 into the service position as mentioned. The support member 52 is attached to the fastening flange 82 at the wall of tank 80. A shield 56 with its flange 58 is mounted to the fastening flange 82 of the wall of tank 80. Preferably, shield 56 extends into the interior of the tank and converges or tapers toward the mixing member thereby facilitating the flow of the fluid. At the end of the shield adjacent to the mixing member is a fastening flange 60. A sliding flange 62 is mounted to fastening flange 60 for ensuring that the mixing member cannot, at any stage, fall into the tank. This possibility of the mixing member becoming detached from the shaft arises if, for some reason, the drive motor, even momentarily, rotates in the wrong direction whereby the spiral-wedge attachment disclosed in the above-mentioned patent will open and cause the mixing member to disengage from the shaft 22. As stated, the mixing member itself is, for example, a propeller with blades 64 which are attached to hub 66. The hub 66 has a center cavity 68 provided with a spiral-shaped member corresponding to the wedge part 30 of the shaft 22. The hub 66 also has a first stepped protrusion 70 having a radius which is larger than the inner radius of the sliding flange 62, and a second stepped protrusion 72 for providing a sealing counter surface for O-rings 76 arranged in two sealing grooves 74 which are machined into the cylindrical outer surface of the sealing flange 60. The end of the cavity 68 of hub 66 at the side of the tank wall has been formed of a substantially tapered hole so that the shaft 22 is readily guided into the cavity 68 in the installation stage.

When the mixer is in operation, the fluid flow conforms to that shown and illustrated in FIG. 1 by the arrows. It has been determined in tests that both the fluid flow and the mixing efficiency will increase substantially depending on the extent of the reach of the mixing member into the tank until the value of reach approaches 0.5× radius of the mixing tank. With the tank geometries in practice today, the reach should in most cases be within the range of about 1 to about 1.5 meters. However, in the previously known arrangements in which the mixing member was mounted at the end of the mixer shaft and wherein the shaft bearings are located in the vicinity of the tank wall, the mixer shaft was strained by turning and deflection loads caused by the weight of both the blade and the shaft and the blade torque caused by the uneven loading of the mixing member. The deflection of the shaft at the sealing caused by the deflection load results in the leakage at the sealing, in unusual wear in relatively short time and, finally, in damage to the sealing itself. Alternatively, very expensive sealings or sealing arrangements had to be used due to the considerable distance between the bearing support and the mixing member.

The apparatus according to the present invention results in only small shaft deflection, if any, which enables, for example, the use of small slide ring sealings or equivalent sealing means similar to those used in the pump industry and which are manufactured in series production. In addition, other stresses on the mixing unit are also reduced to such an extent that a thinner shaft and consequently smaller and less expensive bearings of series production may be employed.

Mixer parts subject to wear or susceptible to damage are the drive means, gear, bearings of the secondary shaft and the shaft sealings. In the mixer of the present invention, the parts enumerated above and especially the shaft sealing should be designed for durability. Nevertheless, should there occur any operating problems, the mixer may either be dismantled or replaced by a similar mixer quickly and without the necessity of emptying the mixing tank.

Dismantling and reassembly of the apparatus itself is carried out as follows: The mixer is stopped and the nuts of the fastening flange 20 are loosened thus allowing the part 10 of the mixer to be removed in axial direction. During disassembly of the mixer, part 10 is supported by rollers 32 on rails 54. The mixer is thus removed outward in the axial direction by means of screws inserted into the fastening flange 20 or by some other suitable known means. Thereafter, the sliding surface of the shaft sealing cage 28, i.e, the cylindrical surface external to the cage, is moved relative to the sealing flange 60, and the stepped protrusion 72 of hub 66 of the mixing member is moved into the opening of the sealing flange 60. Due to double sealing means 74, 76, which may, for example, be O-rings, of sealing flange 60, the device is always sealed from the direction of the tank 80. The mixer can be moved until it is stopped by stops of hub 66 in connection with the sliding flange 62.

A scale may be provided for determining the extent of removal, for example, by appropriate markings on the support member 52. Thereafter, the hub 66 is locked in place by means of a locking device 78 and by turning the locking device, for example, through a rod. An eccentric ring disposed on the locking device 78 locks into a groove within hub 66 of the mixing member thereby resulting in a tight connection with hub 66. If the spiral-wedge attachment 30 as disclosed in the abovementioned patent is used, the mixer shaft 22 is turned, for example, by the coupling of gear 16, whereby the shaft 22 becomes detached from the hub 66 and the unit 10 may be further removed. Experience gained with spiral-wedge arrangements show that the shaft can easily be detached from the hub. When the shaft is completely detached, the part 10, supported by rails 54 of the support member 52, is moved to the stops. Removal may be effected by an arm of a removal wheel or by some other suitable known means. The mixer is then in the service position and, for example, a sealing or bearing may be replaced or the entire mixing unit be transferred to the workshop for repairs and replaced by a similar mixing unit.

Sealing towards tank 80 is maintained during the entire service operation. The flange 58 of the shield 56 is at all times fixed to the flange ring 82 of the tank 80 and the hub 66 is located inside the sealing flange 60 of the shield 56. The hub 66 sealingly engages the sealing flange 60 and furthermore, the sealing action of hub 66 is enhanced by forces such as hydrostatic and other pressures in the tank 80 which also depend on the diameter of the hub. After servicing the unit, the mixer is returned into operating position in the reverse order.

It should be understood that the preferred embodiment described above is for illustrative purposes only and is not to be construed as limiting the scope of the invention which is properly delineated only in the appended claims.

What is claimed is:

1. A mixer for attachment to a tank defined by a wall for receiving and mixing fluid therein, comprising:

an elongated shaft having a first end and a second end extending into said tank;

a mixer member detachably attached to said second end of said shaft;

means for removing said shaft from said tank when desired without removing said mixing member from said tank;

a frame for connection to said tank wall;

means for bearing and sealing said shaft mounted on said frame adjacent said mixing member; and shield means in fluid contact in said tank and surrounding said frame for shielding said frame from fluid in said tank and preventing said fluid from contacting said frame, said shield means being elongated along said shaft elongation and supporting said mixing member in said tank when said mixing member is attached to said shaft and when said shaft is removed to thereby avoid having to empty the tank of fluid when said shaft is removed.

2. The mixer as claimed in claim 1, wherein said shield means extends into the immediate vicinity of said mixing member.

3. The mixer as claimed in claim 1, additionally comprising a sealing flange provided at the end of said shield facing said mixing member; and means sealingly engaging said sealing flange for sealing the inside of said shield being in fluid contact in said mixing tank.

4. The mixer as claimed in claim 3, wherein said mixer can be brought into an operating position and into a service position and additionally comprising a sealing cage at the end of said frame (18) facing said mixing member and engaging said sealing flange (60) and sealing means (76) for sealing the space defined by said shield (56) relative to the mixing tank (80) in said operating position and said service position.

5. The mixer as claimed in claim 1, additionally comprising a mixer part (10) including a drive means for driving said shaft; and means (52) for supporting said mixer part (10) during removal thereof from said tank.

6. The mixer as claimed in claim 5, additionally comprising rails (54) on said support means (52) and rollers (32) provided on said mixer part (10) and engaging said rails for supporting said mixer part.

7. The mixer as claimed in claim 1, wherein said tank has a radius and said shield (56) is cone-shaped for guiding said fluid, said cone-shaped shield extending into said tank (80) for a distance of about $0.5 \times$ radius of said tank.

* * * * *